United States Patent [19]

Krause

[11] 3,941,325

[45] Mar. 2, 1976

[54] ARTICLE SUPPORT

[76] Inventor: Richard P. Krause, 1503 Highland Ave., New Castle, Pa. 16101

[22] Filed: Aug. 21, 1974

[21] Appl. No.: 494,381

[52] U.S. Cl. ..... 242/55.54; 242/139; 211/105.1

[51] Int. Cl.[2] ..... B65H 19/00

[58] Field of Search ..... 242/55.54, 55.42, 139; 211/105.1, 123, 86; 248/214

[56] References Cited

UNITED STATES PATENTS

| | | | |
|---|---|---|---|
| 3,076,556 | 2/1963 | White | 211/105.1 |
| 3,539,124 | 10/1970 | Belokin, Jr. | 242/55.54 |
| 3,622,010 | 11/1971 | Renelt | 242/55.54 |

FOREIGN PATENTS OR APPLICATIONS

| | | | |
|---|---|---|---|
| 285,769 | 2/1928 | United Kingdom | 242/55.54 |

*Primary Examiner*—Leonard D. Christian
*Attorney, Agent, or Firm*—Brown, Murray, Flick & Peckham

[57] ABSTRACT

A shelf having front and rear ends is adapted to rest on a horizontal bar spaced from a wall to which it is attached. A vertical stabilizing member extends downwardly from the rear end portion of the shelf between the bar and the wall and has an adjusting pin projecting from its back into engagement with the wall to hold the shelf horizontal while the back of the shelf engages the wall. The pin also projects from the front of the stabilizing member and supports a nut that is adjusted forward on the pin to engage the back of the bar to hold the rear ends of the shelf and pin against the wall.

13 Claims, 4 Drawing Figures

ARTICLE SUPPORT

In my allowed patent application, Ser. No. 356,613, now U.S. Pat. No. 3,844,500, a similar device is shown, on which the present invention is an improvement. In the pending application the stabilizing member always engages the back of the supporting bar. This means that the rear end of the shelf is spaced from the wall, in view of which it is possible under certain conditions for the front end of the shelf to tilt up. A more rigid mounting for the shelf is desirable.

It is among the objects of this invention to provide a holder for a roll of paper, which can be quickly and easily hung from a wall without attaching it to the wall, which can be located in any desirable position along the usual towel bar, which includes a carrier by which a roll of paper can be carried to another location temporarily, which has means on the carrier to prevent accidental unwinding of the roll of paper, in which part of the holder forms a shelf that can support other articles when the roll carrier is not resting on it, and in which the shelf is pressed against a wall in spite of variations in distance between towel bars and their supporting walls.

The invention is illustrated in the accompanying drawings, in which

Figure 1:
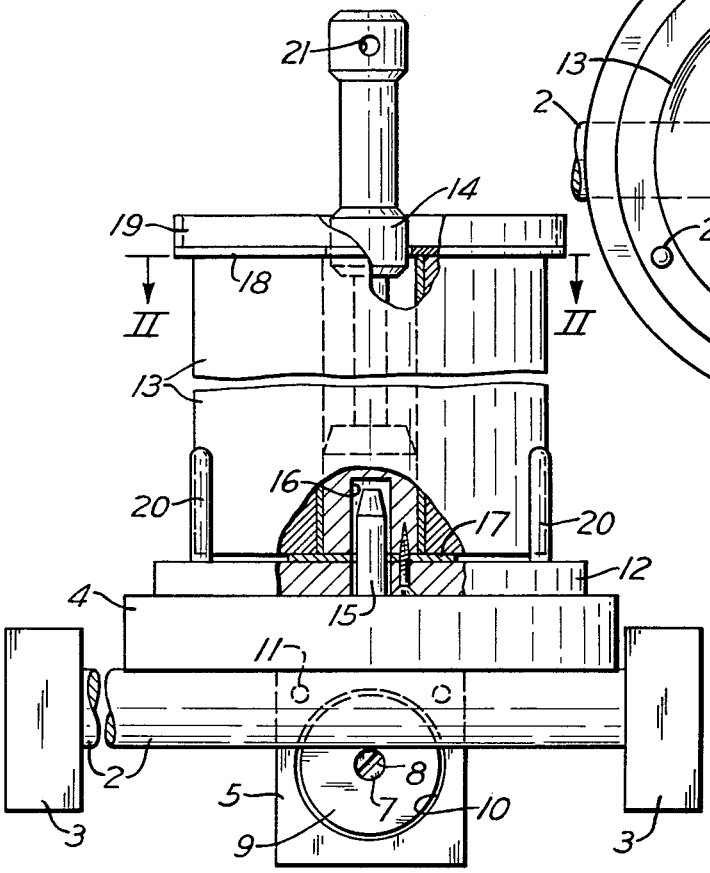
FIG. 1 is a front view with parts broken away.
Figure 2:
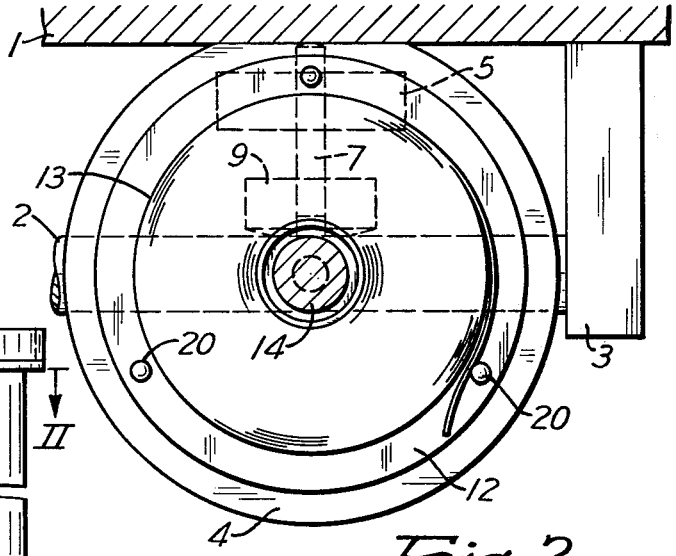
FIG. 2 is a plan view.
Figure 3:
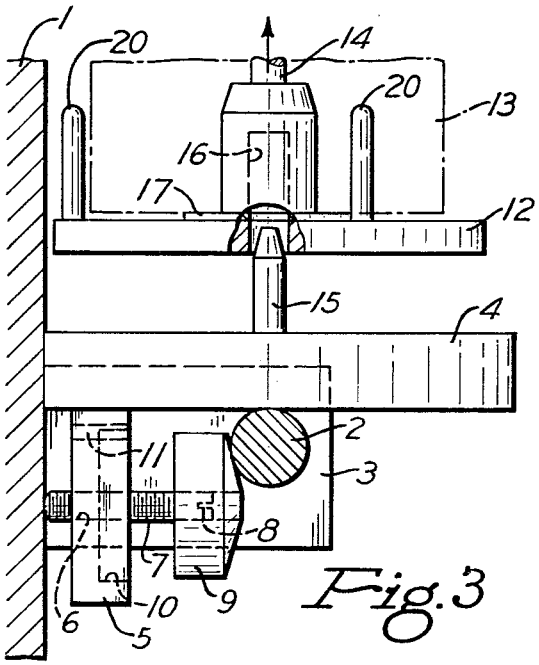
FIG. 3 is a side view showing the roll carrier lifted from the shelf.

Referring to FIGS. 1 to 3 of the drawings, a conventional towel rack is shown attached to a wall 1 of a bathroom or kitchen. This rack is formed from a horizontal towel bar 2 of any desired cross sectional shape supported at its ends by brackets 3 secured to the wall and spacing the bar from the wall in the customary manner. Supported by the towel bar is a flat shelf 4 that extends several inches in front of the bar. The front part of the shelf may be curved in a horizontal plane if desired, as shown in FIG. 2, but the back of the shelf is flat for engaging the wall. To hold the shelf on the bar, a vertical stabilizing member 5 is rigidly secured at its upper end to the bottom of the shelf adjacent the rear end of the shelf. This member may be a plastic, hard rubber, metal, or wooden block or it can be made of any other suitable material. It extends downwardly between the towel bar and the wall of the room and preferably is spaced a short distance in front of the rear end of the shelf so that it will not prevent the back of the shelf from engaging the wall if the wall bulges forward beneath the shelf.

The stabilizing member is provided with an opening 6 extending through it from front to back below the level of the towel bar as shown in FIG. 3. Extending through this opening is an adjusting pin 7, the rear end of which projects from the back of the stabilizing member and engages the surface of the wall. Preferably, the pin is provided with a screw thread and the wall of opening 6 also is threaded. The front end of the threaded pin extends forward from the stabilizing member and is provided with means for turning it, such as a screwdriver slot 8. It is a feature of this invention that mounted on the pin in front of the stabilizing member is a nut 9, the upper portion of which is disposed between the towel bar and the stabilizing member.

With the rear end of the adjusting pin backed into the stabilizing member or projecting only slightly from it, and with nut 9 turned on the pin until it is close to the stabilizing member, that member and the pin and nut are lowered down between the towel bar and wall until the shelf 4 rests on the bar. The shelf is moved back against the wall and held there firmly while the shelf is tilted on the bar to whatever extent is necessary to make it horizontal. Then while still holding the shelf in that position, the adjusting pin is turned until its rear end engages the wall. Nut 9 now is turned on the pin to move the nut forward until it presses against the back of the towel bar. This prevents the shelf from moving away from the wall. Also, engagement of the shelf and adjusting pin with the wall at two different levels, and engagement of the nut with the bar at an intermediate level, prevent the shelf from tilting on the bar out of horizontal position.

It will be seen that since the nut can be adjusted along the threaded pin, the shelf can be seated on towel bars where there is considerable variation in the spacing betwen bars and walls. To provide for minimum spacing, the front of the stabilizing member can be provided around the adjusting pin with a circular recess 10 for receiving part of the nut when there would not be room for all of it in front of the stabilizing member. This is not necessary, however, if the stabilizing member is made considerably thinner than shown.

Such a shelf can be used as additional small shelf space for supporting many different articles; such as, for example, rings or a wrist watch while a person is washing his hands. If it is desired to permanently attach the shelf to a wall, screws can be inserted in openings 11 that are located in the stabilizing blocks 5 above the level of the adjusting pin. Before doing this, nut 9 is removed as it will not be needed. The adjusting pin is used for levelling the shelf and then the screws are screwed into the wall.

The shelf is escpecially suitable for supporting the base 12 of a carrier for a roll of paper 13 or the like, "paper" being used herein to cover any strip forming a roll. This base preferably is circular as shown in FIG. 2, and is provided in its center with a vertical opening. The lower end of a post 14 is rigidly mounted at the center of the base as shown in FIG. 3, and is tall enough to extend up through the roll of paper encircling it. The shelf is provided with upwardly projecting retaining means for preventing the roll carrier from moving laterally on the shelf. This retaining means may, for example, consist of a locating pin 15 rigidly mounted in the top of the shelf and projecting up into a vertical bore 16 in the lower end of the post. Preferably, a washer 17 clamped between the carrier base and the bottom of the post encircles the post to lift the roll away from the base 12. The post extends far enough above the roll of paper to form a handle that can be gripped in the hand for lifting the carrier and roll from the shelf as shown in FIG. 3 so that, if desired, they can be carried to another location and set down there temporarily. The diameter of the post above the roll is less than the diameter of the axial passage through the roll so that the roll can be dropped down over the post without removing the post from the base. Preferably, a removable disc 18 rests on top of the roll. If this disc is provided with an upstanding side wall or rim 19 as shown, it becomes a tray on which small articles may be placed temporarily.

By tapering the front end of nut 9 as shown in FIG. 3, the towel bar 2 will be clamped between the nut and shelf 4 so that there will be no chance of the shelf being dislodged if bumped from below.

A further feature of this invention is that to prevent the outer wraps of the roll of paper from unwinding and hanging down, the carrier base 12 can be provided with means for holding the outer wrap more or less in place. This can be done with one or more vertical pins 20 rigidly mounted on the carrier base outside of the roll of paper. The pins extend up beside the roll and prevent unrestrained unwrapping of the roll, as shown in FIG. 2.

The holder described herein is simple and inexpensive in construction and can be quickly mounted in place by anyone with no more than a screwdriver. Once in place, it is seated very firmly and will not change its position. It need not be attached to the wall, so it can be removed readily without leaving any evidence of its having been there. It provides a definite place for a roll of paper towels or facial tissue, and yet the roll can be removed from the shelf by the post handle for use elsewhere whenever desired, or to leave the shelf free for the reception of other articles. The upper end of the post can be provided with a hole 21 through it to receive a cord loop by which the carrier base and roll can be suspended from a hook or the like at a location remote from the shelf. Or, a screw eye may be inserted in the upper end of the post for the same purpose.

Figure 4:
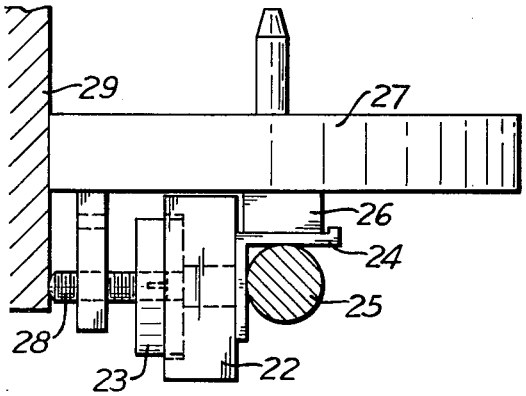
FIG. 4 is a fragmentary side view of a modification.

In the modification shown in FIG. 4, provision is made for situations where the towel bar is too far away from the wall for nut 9 in FIG. 3 to engage it, and also where the rear end of the adjusting pin would not engage anything if the shelf rested directly on the bar. Accordingly, a recessed filler block 22 is supported by nut 23 and engages a short angle member 24 resting on the towel bar 25. Seated on top of the angle member is another filler block 26 that raises shelf 27 above the bar far enough for adjusting pin 28 to engage the wall 29. The wall in this case may be the side wall of a wash bowl, to which the towel bar is attached. Of course, there may be situations where only one of the filler blocks is needed, perhaps with or without angle member 24.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. An article support comprising a shelf having front and rear ends and adapted to be supported by a horizontal bar spaced from a wall to which the ends of the bar are attached, a stabilizing member extending downwardly from the rear end portion of the shelf, an adjusting pin extending rearwardly through said stabilizing member and projecting from the front of that member, the pin being adjustable lengthwise in the stabilizing member, and a nut mounted on the pin in front of the stabilizing member, said stabilizing member and nut being adapted for insertion between such a wall and horizontal bar with the shelf above the bar, and the nut being adjustable forward on said pin toward the back of the bar to hold the rear ends of the shelf and pin against the wall.

2. An article support according to claim 1, in which said pin is provided with a screw thread and is threaded in said stabilizing member, the front end of the pin being formed for turning it, and said nut is threaded on the pin.

3. An article support according to claim 1, in which the front of said stabilizing member is provided with a recess around said pin for receiving said nut when necessary.

4. An article support according to claim 1, including retaining means projecting upwardly from the top of the shelf, a portable carrier base resting on the shelf and normally engaged by said retaining means to prevent lateral movement of said base on the shelf, a post extending upwardly from said base, the carrier being adapted to support a roll of paper encircling said post and spaced inwardly from the edge of the base, and means extending upwardly from said base adjacent its edge for restricting accidental unwinding of a roll of paper on the post.

5. An article support according to claim 4, in which said last-mentioned means include a plurality of vertical pins secured at their lower ends to said carrier base.

6. An article support according to claim 1, including means supported by said shelf and extending upwardly therefrom for encirclement by a roll of paper.

7. An article support according to claim 6, in which said upwardly extending means extends far enough to project above the upper end of a roll of paper thereon, and a tray encircles said upwardly extending means for resting on the upper end of the roll of paper.

8. An article support according to claim 1, including a spacer block adapted to be mounted on the front end of said nut for spacing it from the back of the towel bar.

9. An article support according to claim 1, including a spacer block provided with a recess receiving the front end of said nut.

10. An article support according to claim 1, including an angle member adapted to rest on the towel bar and extend down behind it between the bar and said nut.

11. An article support according to claim 10, including a spacer block for spacing said shelf from the top of said angle member.

12. An article support according to claim 1, in which the front of said nut is tapered forward.

13. A carrier for a roll of paper or the like that has an axial passage extending therethrough, comprising a carrier base, a central post above the base rigidly secured at its lower end to the base and extending up through the roll passage and above the roll to form a handle, the diameter of the post above the roll being less than the diameter of the roll passage, all of said carrier base being located below the roll to permit unrestricted manual unwinding of the roll by pulling the paper in a direction substantially parallel to the base, and at least one rigid vertical pin extending upwardly beside the rolll from said base adjacent its edge for restricting accidental unwinding of the roll.

* * * * *